United States Patent [19]

Mayer et al.

[11] Patent Number: 5,074,180

[45] Date of Patent: Dec. 24, 1991

[54] CLAMPING SYSTEM FOR CLAMPING A CUTTER ROLLER IN AXIALLY SHIFTABLE POSITION ON A SHAFT

[75] Inventors: Bernd Mayer; Ruprecht Maurer, both of Bad Homburg; Bruno Hotz, Schwieberdingen, all of Fed. Rep. of Germany

[73] Assignee: Ringspann GmbH, Bad Homburg, Fed. Rep. of Germany

[21] Appl. No.: 564,342

[22] Filed: Aug. 7, 1990

[30] Foreign Application Priority Data

Aug. 18, 1989 [DE] Fed. Rep. of Germany ..... 3927266

[51] Int. Cl.[5] ..... B26D 1/56

[52] U.S. Cl. ..... 83/700; 83/343; 83/508.2

[58] Field of Search ..... 83/331, 343, 504, 508.2, 83/508.3, 699, 700

[56] References Cited

U.S. PATENT DOCUMENTS

| | | | |
|---|---|---|---|
| 3,172,326 | 3/1965 | Hamilton | 83/700 |
| 3,532,019 | 10/1970 | Mefzger et al. | 83/700 |
| 3,908,499 | 9/1975 | Reed | 83/699 |
| 3,985,066 | 10/1976 | Kern | 83/699 |
| 4,485,710 | 12/1984 | Schlisio et al. | 83/699 |
| 4,594,926 | 6/1986 | Propheter | 83/699 |
| 4,932,298 | 6/1990 | Capdebosco | 83/699 |
| 4,962,684 | 10/1990 | Mowry | 83/508.2 |

FOREIGN PATENT DOCUMENTS

| | | |
|---|---|---|
| 2126018 | 12/1972 | Fed. Rep. of Germany . |
| 3321505 | 12/1984 | Fed. Rep. of Germany . |

*Primary Examiner*—Frank T. Yost
*Assistant Examiner*—Scott A. Smith
*Attorney, Agent, or Firm*—Frishauf, Holtz, Goodman & Woodward

[57] ABSTRACT

To permit rapid axial relocation of cutter rollers or cutter wheels (2, 3; 11; 42; 78, 121) on supporting shafts (6, 7; 70, 71; 100), the cutter rollers are located on respective positioning or carrier rings (12, 41, 74, 75; 102, 120 130) surrounding the respective shafts, and are axially clamped in position by a rotatable operating ring (13, 22, 28, 40, 52, 88, 89; 107, 126, 138), rotatable about said positioning ring. The operating ring is rotatable, for example by being operator-accessible, at any circumferential position of the shaft, a hydraulically operated compression sleeve, or the like, so that the axial position of the cutter roller or wheel can be changed on the shaft regardless of the circumferential position of the shaft when it comes to rest after having cut a web into a ribbon, the width of which is to be changed.

28 Claims, 13 Drawing Sheets

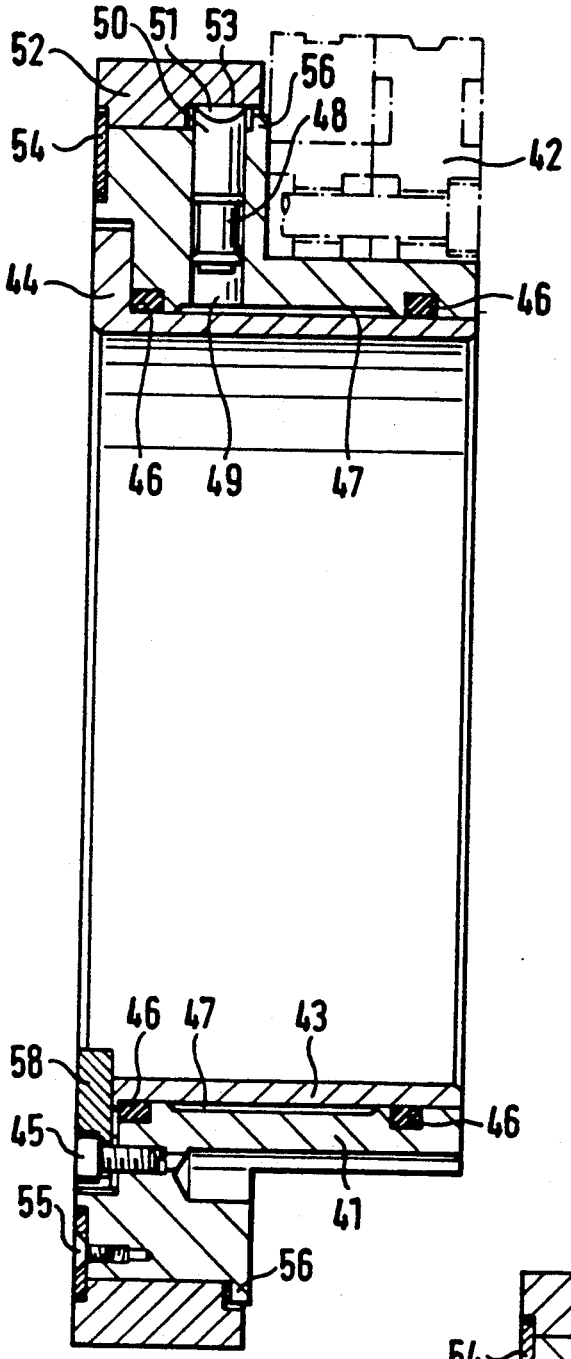
FIG. 11
FIG. 12
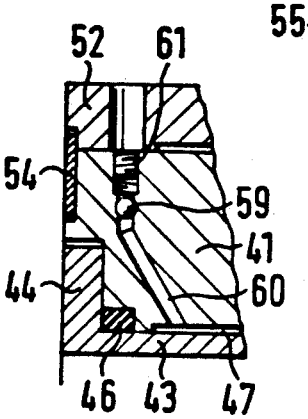
FIG. 13
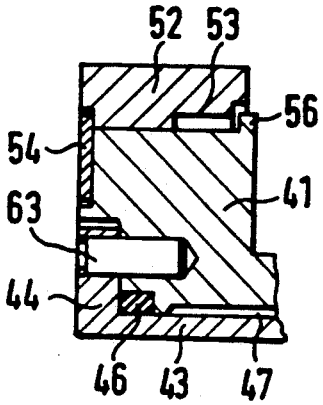

CLAMPING SYSTEM FOR CLAMPING A CUTTER ROLLER IN AXIALLY SHIFTABLE POSITION ON A SHAFT

Reference to related publications:
German Patent Disclosure Document 21 26 018
German Patent Disclosure Document 33 21 505

FIELD OF THE INVENTION

The present invention relates to a system to clamp a cutter roller or cutter wheel or disk on a shaft in such a manner that the cutter roller can be axially shifted on the shaft, while being rotated with the shaft, and in which the axial shifting arrangement is accessible to an operator at a plurality of circumferential positions of the shaft so that the axial position of the cutter roller can be adjusted independently of the angular position of the shaft when the cutter roller has come to rest.

BACKGROUND

Various types of cutting arrangements using cutter rollers placed on parallel shafts are known. Usually, a pair of cutter rollers cooperate, in that the cutter roller of one shaft is positioned to cut against the cutter roller of a stagger parallel shaft. Usually, the sums of the radii of the engageable cutter rollers are greater than the axial spacing of the parallel shafts, and the shafts are so located that immediately adjacent cutter rollers overlap, thus providing a shearing effect or a scissor cutting effect on a web which is passed between the cutter rollers.

If a web is to be cut, for example into a plurality of ribbons of the web material of predetermined width, and the width of the ribbons is to be changed, it is necessary to re-position the cutter rollers on their respective shafts in desired or selected positions. This requires loosening the cutter rollers from rotation engagement with the shafts, and re-positioning them in a new desired or selected position thereon. If the cutting pattern is to remain the same for a long period of time, suitable set screws and the like can adjust the position of the cutter wheels once and for all by hand, without further problems being encountered. If, however, the position of the cutter wheels on the shafts is to be changed frequently, to make ribbons or sub-webs of different widths, frequent change of the axial position of the cutter rollers on the shafts is necessary.

It has previously been proposed, see German Patent Disclosure Document 21 26 018, to provide a positioning and clamping element interposed between the shaft and the cutter roller, which clamping element can be subjected to a pressure force, to expand the clamping element and, selectively, effect clamping between the positioning ring and carrier for the cutter wheel and, hence, clamping it in position, while permitting release upon change in pressure level and axial shifting of the cutter wheel. This arrangement, however, has a disadvantage. As the shaft carrying the cutter wheel rotates, the operating element to control the clamping force continually changes its rotary position. To change the axial position of a cutter wheel, the shaft is stopped. The angular position of the shaft, when it stops, is not predetermined. Thus, it is necessary to rotate the shaft, either manually or in a "creep" mode under power, to expose the operating elements for the clamping system and bring them into a region so that an operator can release the clamping engagement and reposition the cutter wheels.

If the shafts are heavy, and can be rotated, effectively, only under power, arrangements are then required to determine the angular position of the shaft, and controlling further rotation of the shaft to reach a final or stopped position at a predetermined location. These are subject to malfunction, and greatly increase the system and apparatus requirements of a cutter apparatus.

THE INVENTION

It is an object to provide a clamping system for cutter wheels, rollers, disks or the like, in which an operating element can be controlled by an operator independently of the angular position at which the shaft, and hence the cutter wheel stops, which is simple, inexpensive, and reliable in operation.

Briefly, the cutter wheel is located on a positioning ring which is slidable axially on the shaft, while rotating therewith. A clamping arrangement is provided to axially adjustably clamp the positioning ring to the shaft at an axially selected position. In accordance with a feature of the invention, a rotatable operating ring surrounds the positioning ring, and is operatively coupled to the clamping arrangement, to selectively effect clamping engagement with the shaft at a desired axial position of the cutter roller, and release from the desired axial position and permitting re-positioning of the cutter roller. The rotatable operating ring is operator-accessible and operable from a plurality of circumferential positions.

The arrangement in accordance with the invention has the advantage that the operator-accessible element, namely the operating ring, completely surrounds the positioning ring and thus can be controlled for clamping or unclamping operation independently of the angular position at which the shaft, and hence the positioning ring has stopped.

The operating ring can be controlled directly by an operator or can be automatically controlled, by constraining position of the operating ring by a suitable apparatus while the shaft and positioning ring are rotated therebeneath. Preferably, the operating ring is formed with arrangements to engage the outer circumference thereof to prevent rotation thereof when not desired. This, then, eliminates the danger that holding elements could slip off the operating ring and thus rotate the operating ring together with the shaft by random, undesired frictional engagement and does not, however, securely clamp the clamping arrangement at a desired position.

The operating ring, in one form of the invention, has a cam track which changes its radial distance from the center of rotation of the shaft with respect to the circumferential angular position thereof. The cam track is coupled to a radially slidable element and, when the operating ring is rotated into a position where the spacing from the center of the shaft to the cam track is less, provides for clamping the operating ring, and hence the positioning ring, together, so that the operating ring and positioning ring are securely clamped to the shaft in axial position. Relative rotation between the operating ring on the one hand and the positioning ring, on the other, or the shaft, respectively, thus effects clamping or, selectively, release of clamped engagement of the positioning ring and hence of the cutter roller with respect to the shaft on which it is located.

Preferably, the operating ring is located on the positioning ring in axially fixed location.

In accordance with another preferred feature of the invention, the clamping mechanism is so arranged that the clamping force is applied to the shaft within the axial width or region of the positioning ring. The clamping force can be applied to the positioning ring in such a manner that the clamping element is only radially shiftable, for example in an eccentric position. The cutter roller which is coupled to the positioning ring thus will be placed independently of the position of the operating ring, so that the quality of the cut being made is not influenced by the position of the operating ring. If the cutter roller is only eccentrically shifted, at its axially predetermined position, the only change, during rotation, will be a difference in the degree of overlap between the respective cutter rollers, without, however, affecting the quality of the cut being made thereby.

Eccentricity will also result if the positioning ring has a recess at the side opposite the clamping arrangement, the recess extending parallel to the axis of rotation of the shaft. Such an arrangement has the advantage that a dual-line or dual-surface engagement will result between the positioning ring and the shaft, which is particularly effective in preventing wobble of the positioning ring, and hence of the cutter wheel or disk on the shaft, and thus results in excellent straight cuts of the web.

DRAWINGS

FIGS. 11, 12 and 13 are axial cross sections along lines XI—XI, XII—XII, and XIII—XIII of FIG. 10;

DETAILED DESCRIPTION

Figure 1:
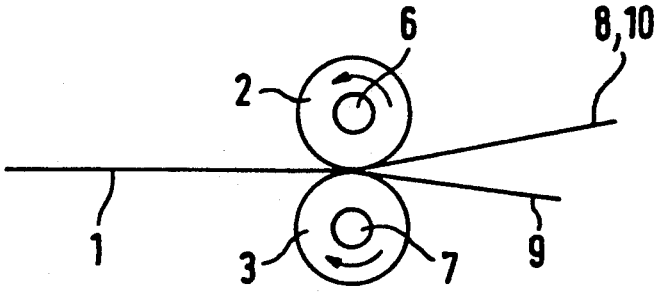
FIG. 1 is a highly schematic side view of a longitudinal web cutting system.
Figure 2:
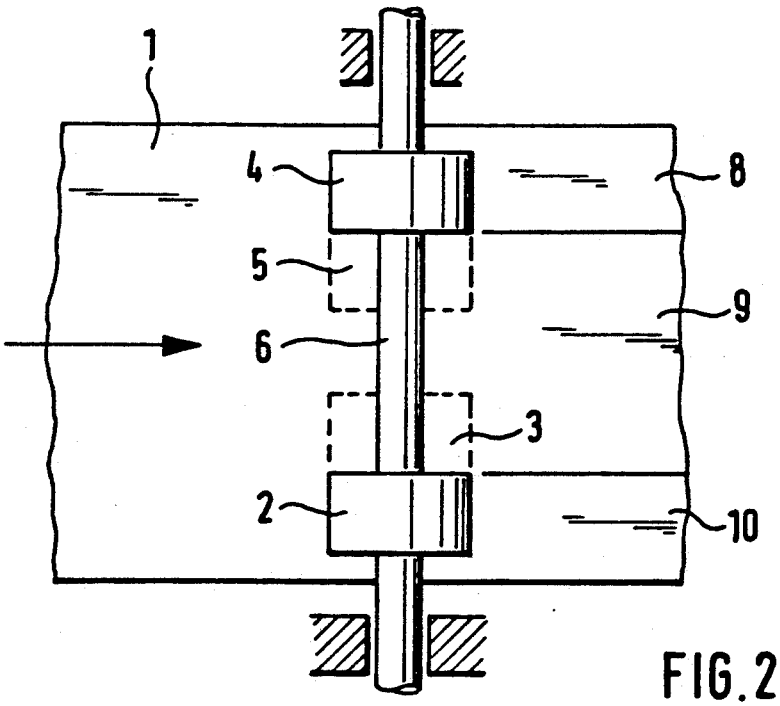
FIG. 2 is a simplified top view of the system of FIG. 1.

Referring first to FIGS. 1 and 2 which, highly schematically, illustrate an apparatus for longitudinally cutting a web 1.

The web 1 is passed between a pair of cutting rollers, cutting disks, or cutting wheels 2, 3 and 4, 5, respectively. The cutting rollers 2, 3; 4, 5 are located on parallel shafts 6, 7 The cutting rollers 2, 3; 4, 5 are located immediately adjacent each other, see FIG. 2, and overlap circumferentially, in part. At the point of overlap, they generate a shear effect, similar to a scissor cut, with a portion of their circumference.

After the web has passed through the pairs of cutter rollers, the web 1 is severed into ribbons or sub-webs 8, 9, 10 which can be rolled or handled in any suitable manner, not further shown. The width and, if desired, also the number of the respective ribbons or sub-webs of paper can be varied by shifting the cutter roller pairs 2, 3; 4, 5 axially.

In accordance with a feature of the invention, any one of the cutter rollers 2, 3; 4, 5, which will hereinafter be given the designation of cutter roller 11, is secured to a positioning ring 12, which is surrounded by an operating ring 13, see FIGS. 3 and 4. The operating ring 13 is axially located in position by axial engagement against one side of the cutter ring and additionally by a C-ring or similar abutment arrangement fitted on the positioning ring 12.

The operating ring 13 is formed at its outer circumference with a plurality of grooves 15 to permit application of a rotary force to the operating ring, and adjust the clamping engagement or release of clamped engagement of the positioning ring 12 with the respective shaft 6, 7.

In accordance with a feature of the invention, the inner contour of the operating ring 13 is formed with an eccentric recess, or a cam track 16, which has a spacing which varies, circumferentially, from the center of rotation of the respective shaft 6, 7. The cam track 16 is coupled to a clamping pin or bolt 17 which rides on the cam track, and extends axially from the cam track through an opening in the positioning ring 12.

Figure 3:
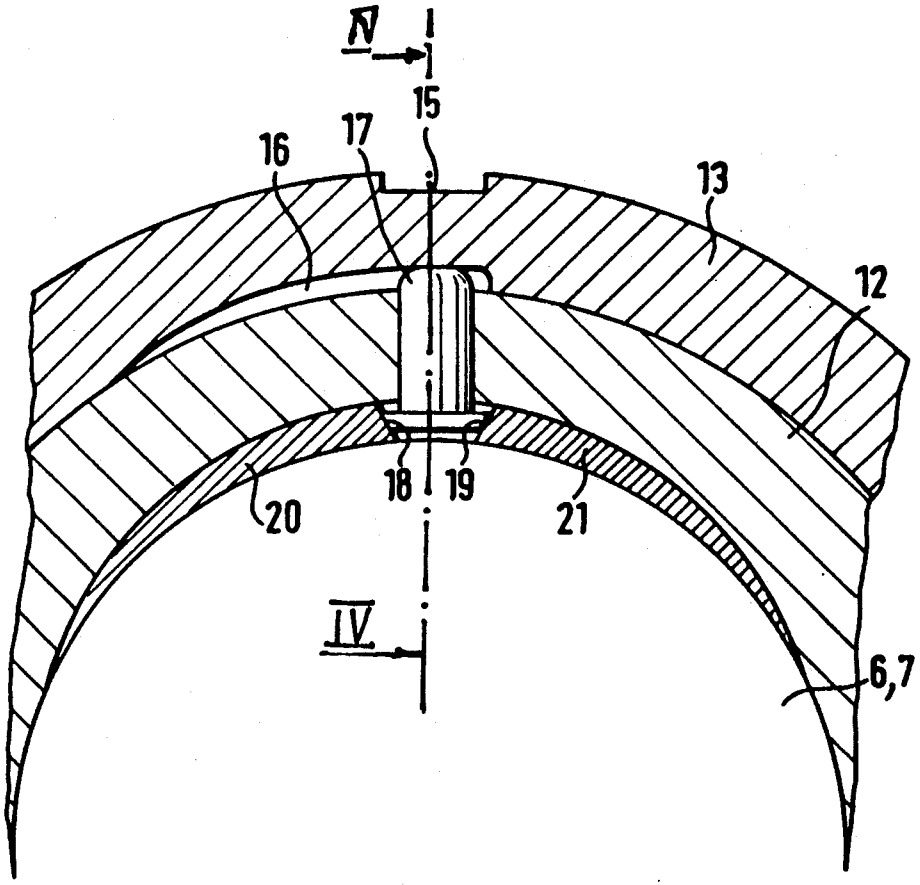
FIG. 3 is a fragmentary axial cross-sectional view illustrating a positioning system in accordance with the invention using a cam track along line III—III of FIG. 4.
Figure 4:
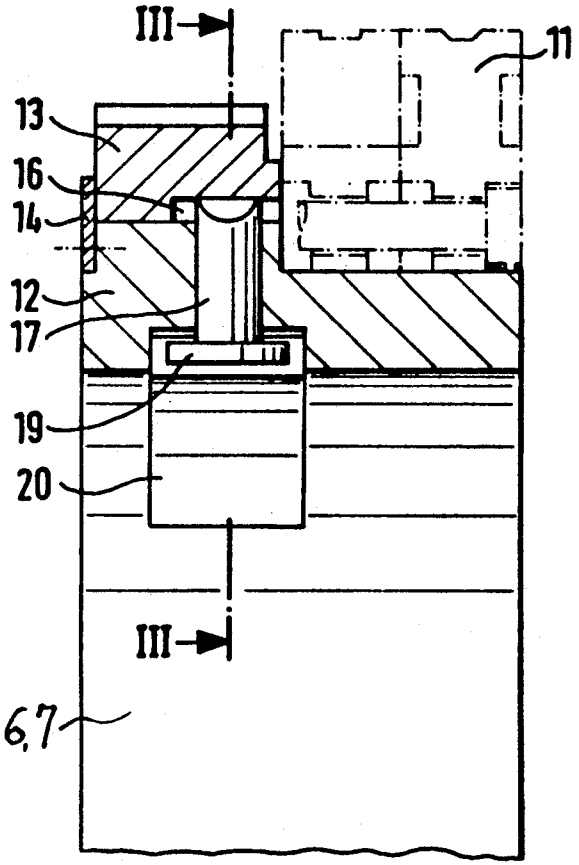
FIG. 4 is an axial section along line IX—IX of FIG. 3.

In the embodiment shown in FIGS. 3 and 4, the clamping bolt or rod 17 is formed with wedging or inclined surfaces 18, 19 at the side remote from its engagement with the cam track 16. The wedging or camming surfaces 18, 19 fit between matching camming surfaces formed in clamping elements 20 21, which fill, essentially, sickle-shaped gap between the shafts 6, 7 and the positioning ring or sleeve 12. Since the positioning ring 12 carries and supports the cutter or knife roller 11, it may also be referred to as a carrier ring or carrier sleeve or carrier bushing.

Upon radial shift of the pin or bolt 17, with respect to the shafts 6, 7, the sickle-shaped clamping elements 20, 21 are pushed outwardly, thereby effecting clamping engagement of the shafts 6, 7 with the positioning or carrier ring 12.

To provide for re-positioning of the knife 11, in axial direction, the wedge surface 18, 19 can be coupled with the clamping elements 20, 21 by a dovetail interconnection so that, when the rod or pin 17 is moved radially outwardly, the clamping engagement between the shafts 6, 7 and the positioning ring 12 is released.

Radial coupling of the positioning ring or sleeve to the shaft can be obtained by forming a spline groove in the respective shafts 6, 7 and in the carrier sleeve or ring 12, for coupling by a rocker or spline element.

Figure 5:
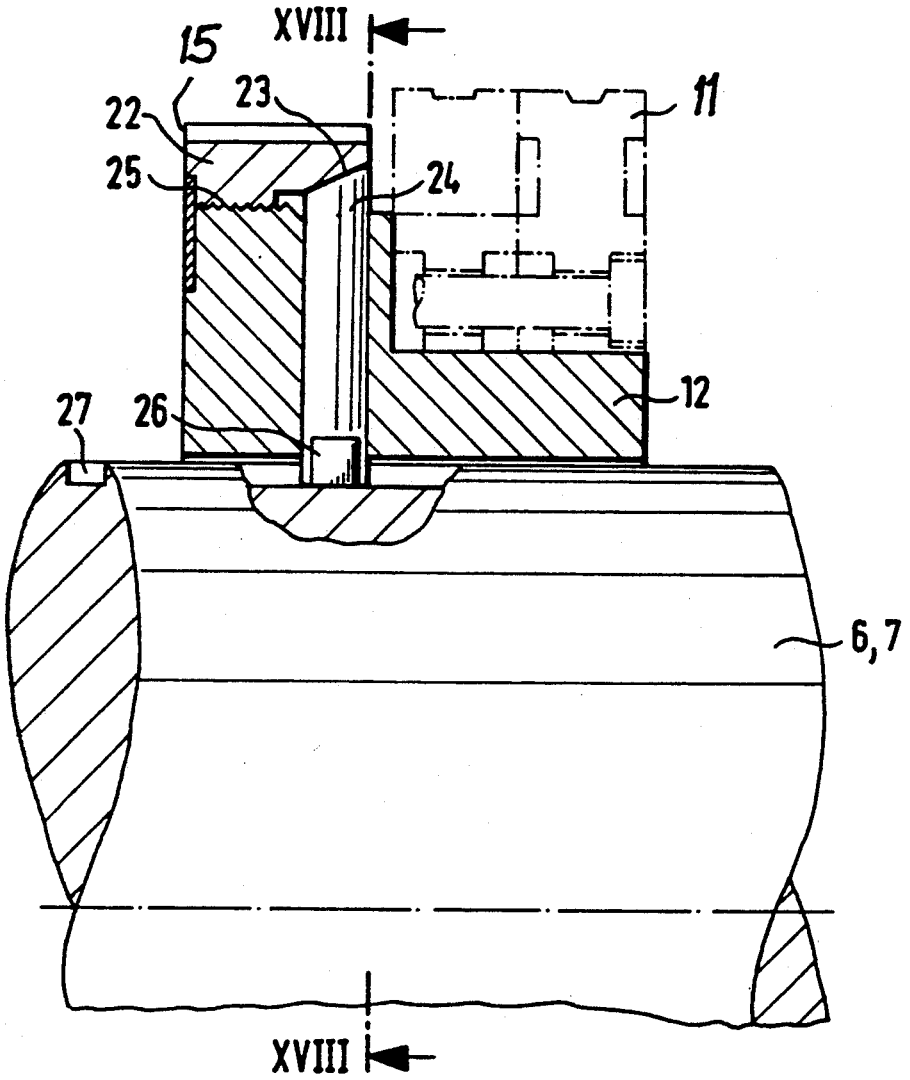
FIG. 5 is a fragmentary axial section through the system of another embodiment, in which the operating ring has a conical surface and a coupling bolt.

Embodiment of FIG. 5:

The clamping effect to be obtained between the positioning ring 12 and the shafts 6, 7, upon rotation of the operating ring 22, is obtained by forming the operating ring 22, axially inwardly, with a wedge or cone surface 23, which is in engagement with a wedge or cone or rounded surface of a radially shiftable element 24, fitted in the positioning or carrier ring 12. The operating ring 22 is formed with a thread 25 to determine the axial position of the operating ring 22 with respect to the positioning or carrier ring 12.

Operation, FIG. 5:

Upon rotation of the operating ring 22 with respect to the carrier ring 12, the operating ring 12 is axially repositioned due to the thread 25. The conical or cam surface 23 of the radially positionable element 24 is thus pressed against the respective shaft 6, 7. In the embodiment illustrated in FIG. 5, the radially shiftable element 24 is formed with flat portions 26 at the lower end thereof, which engage in a longitudinal groove or spline groove 27 cut or milled into the respective shaft 6, 7. This also ensures that the element 24 and the positioning ring 12 will rotate with shafts 6, 7.

The positioning ring of FIGS. 3 and 4 could likewise be formed with an axially directed cam track to apply radial force against the element 24; alternatively, the arrangement of FIGS. 3 and 4 could be moved between clamped and released positions by an operating ring as described in connection with FIG. 5.

Figure 6:
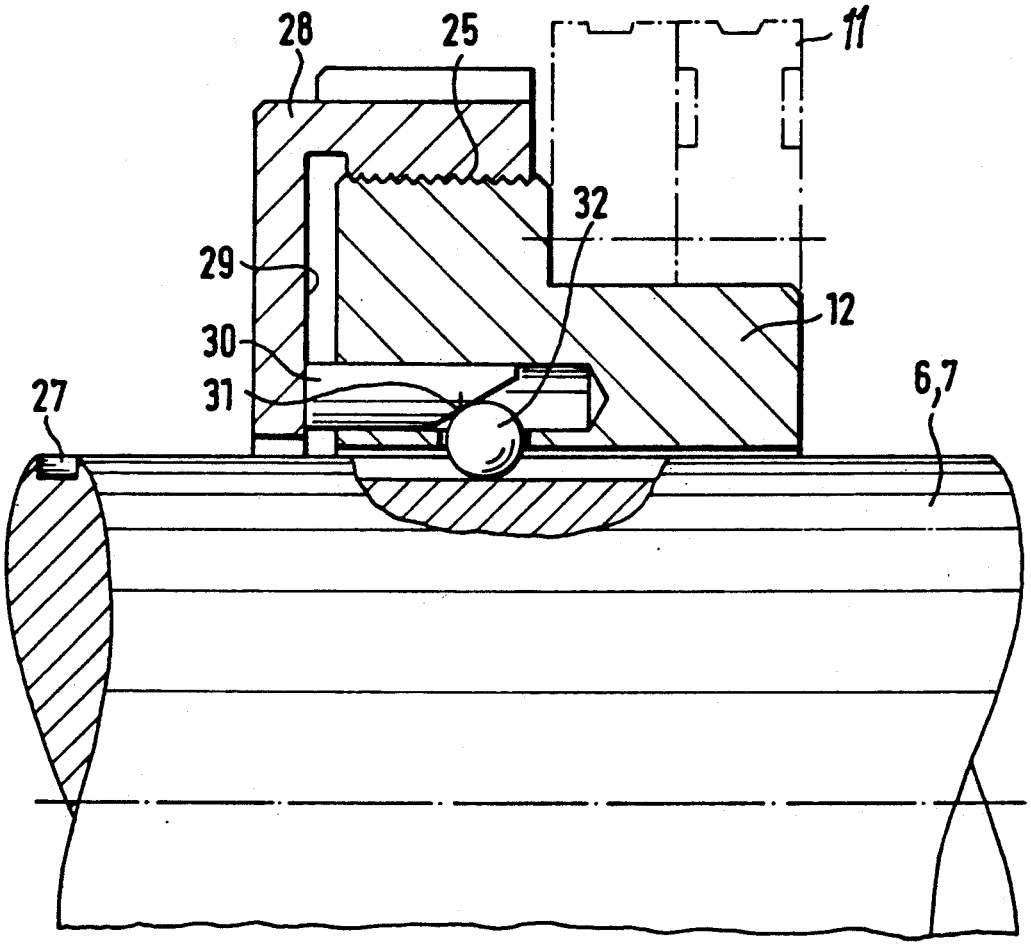
FIG. 6 is a fragmentary axial section through the system in another embodiment, with a radially directed engagement surface and an axially shiftable pressure bolt, engaging a clamping ball.

Embodiment of FIG. 6:

The operating ring 28 is coupled to the positioning ring 12, as in FIG. 5, by a thread 25. The operating ring has an essentially radially extending surface 29 which engages axially positioning and axially shiftable pressure elements 30. The elements 30 are formed with an inner inclined or cam surface 31 and engage a clamping ball 32 to press the ball 32 radially against the shafts 6, 7. The clamping ball 32 also ensures conjoint rotation of the shafts 6, 7 and the carrier or positioning ring 12, since the ball is fitted into a groove 27 in the respective shaft.

A similar arrangement can be used to that described in connection with FIGS. 3, 4 or 5, by replacing the ball 32 by another engagement element, such as a pin or rod; and, similarly, the operating ring can be constructed in accordance with FIG. 3, 4 or 5.

Figure 7:
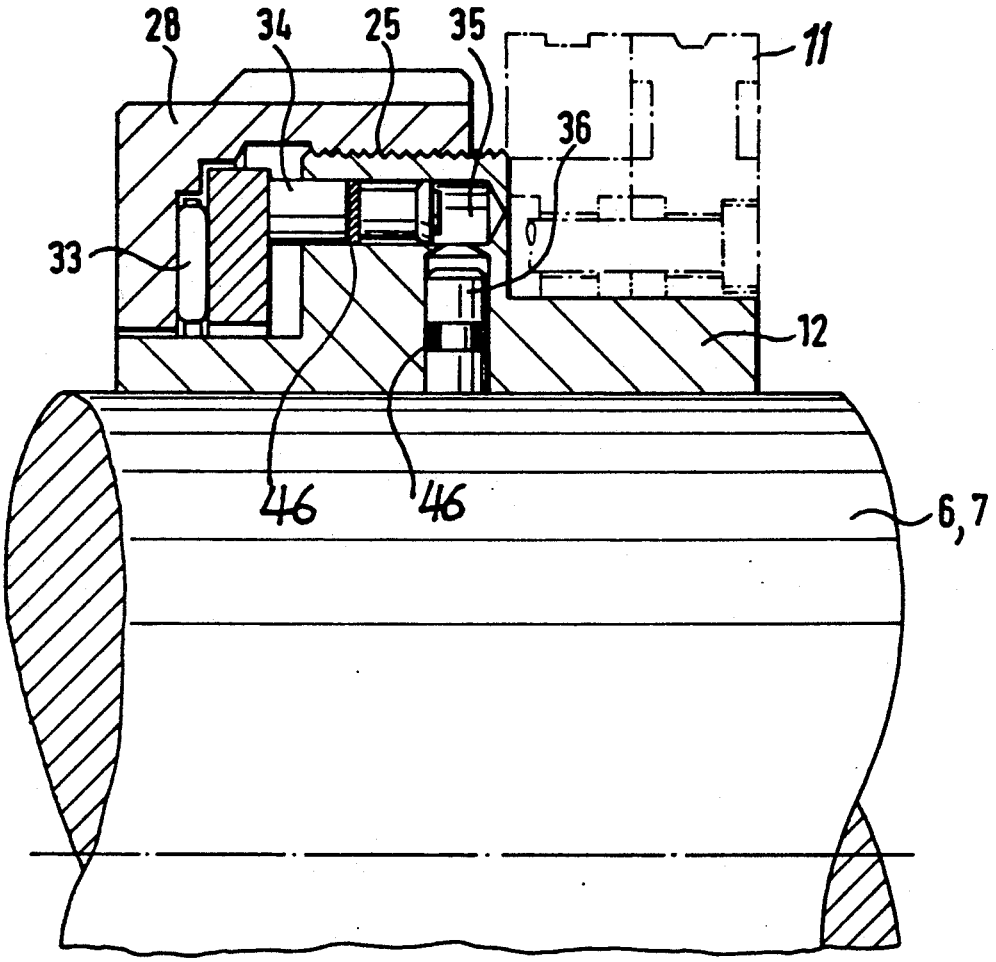
FIG. 7 is an axial cross-sectional view of yet another system using a hydraulically operated coupling bolt.

Embodiment of FIG. 7:

The operating ring 28 is coupled to the carrier or positioning ring 12 by a threaded connection 25. A roller bearing 33, which may be a ball bearing, is interposed between the axially shiftable operating ring 28 and the clamping elements, to reduce frictional forces. The axially shiftable element 34, in the embodiment of FIG. 7, is a hydraulic piston which is engaged in a pressure space 35 and presses a hydraulically shiftable piston 36 against the shafts 6, 7, in order to clamp the positioning ring or sleeve 12 to the shafts 6, 7.

The hydraulic piston 34, of course, could be shifted in position by operating rings as described in FIG. 3, 4 or 5, and would then replace the radially shiftable portions in those embodiments. Of course, any one of the clamping arrangements described in connections with FIGS. 3-6 could be equally operated as described with respect to FIG. 7, that is, for example, hydraulically.

Figure 8:
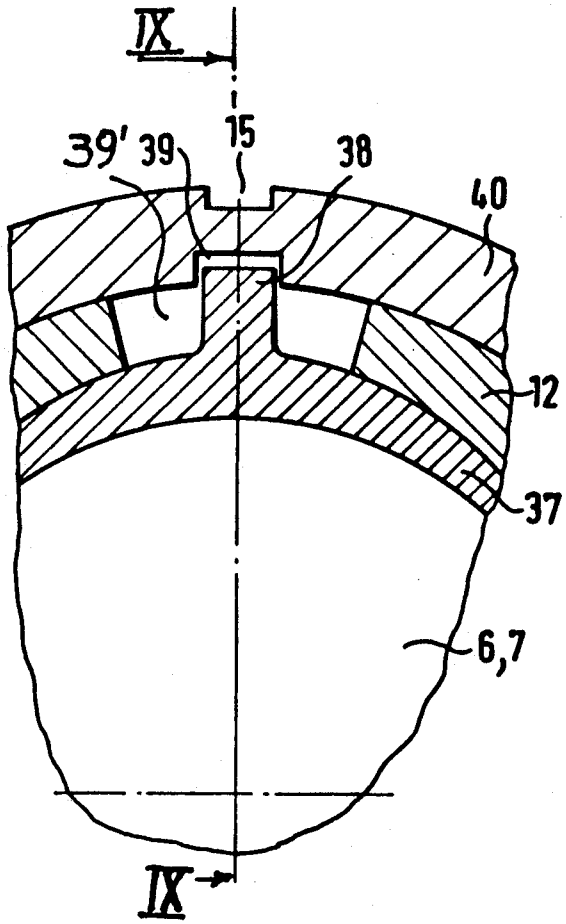
FIG. 8 is a radial sectional view of the system using an eccentric ring positionable by the operating ring, taken along line VIII—VIII of FIG. 9.
Figure 9:
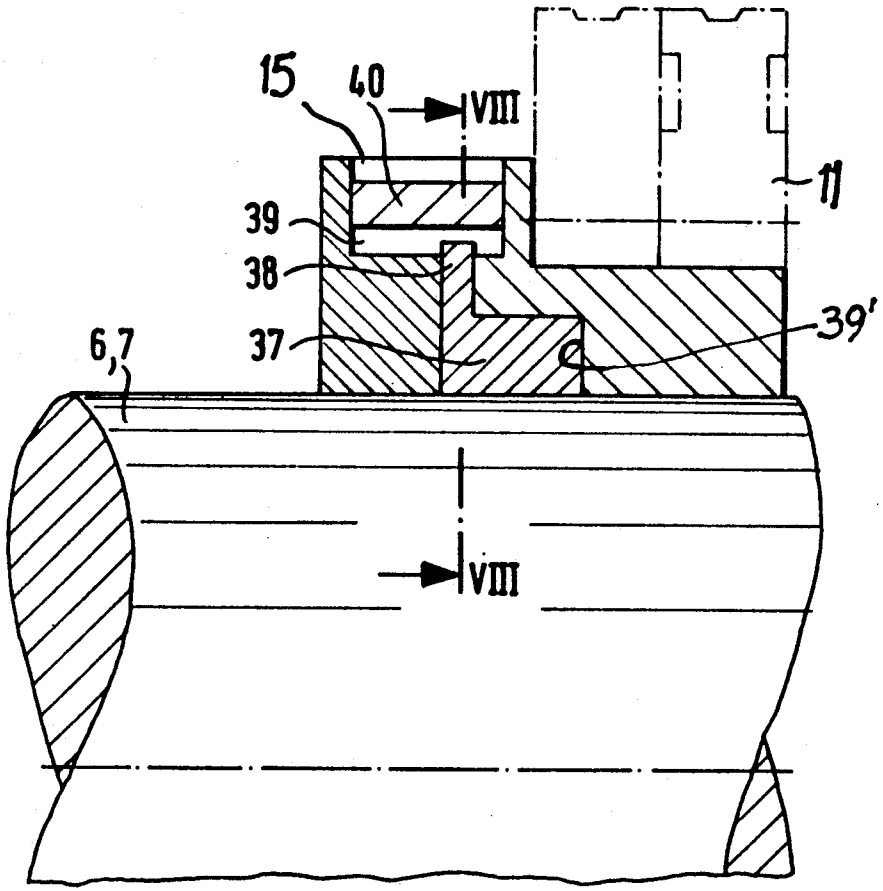
FIG. 9 is an axial cross-sectional view along line VIII—VIII of FIG. 8.

Embodiment of FIGS. 8 and 9:

The positioning sleeve 12 is formed with a circumferential 39'. A clamping ring 37 having an eccentric cross-sectional path, with respect to its circumference, is fitted between the positioning ring 12 and the respective shaft 6, 7. The clamping ring 37 has a radially externally projecting pin or bolt element 38 which engages in an axially extending groove or bore 39 formed in the operating ring 40, at a predetermined axial position thereof. Preferably, the projection 38 is located at the thickest part of the eccentric clamping element 37.

By rotating the operating ring 40, the clamping ring 37, likewise, is rotated and, due to its eccentricity, effects clamping of the positioning ring or carrier ring 12 to the respective shaft 6, 7.

Figure 10:
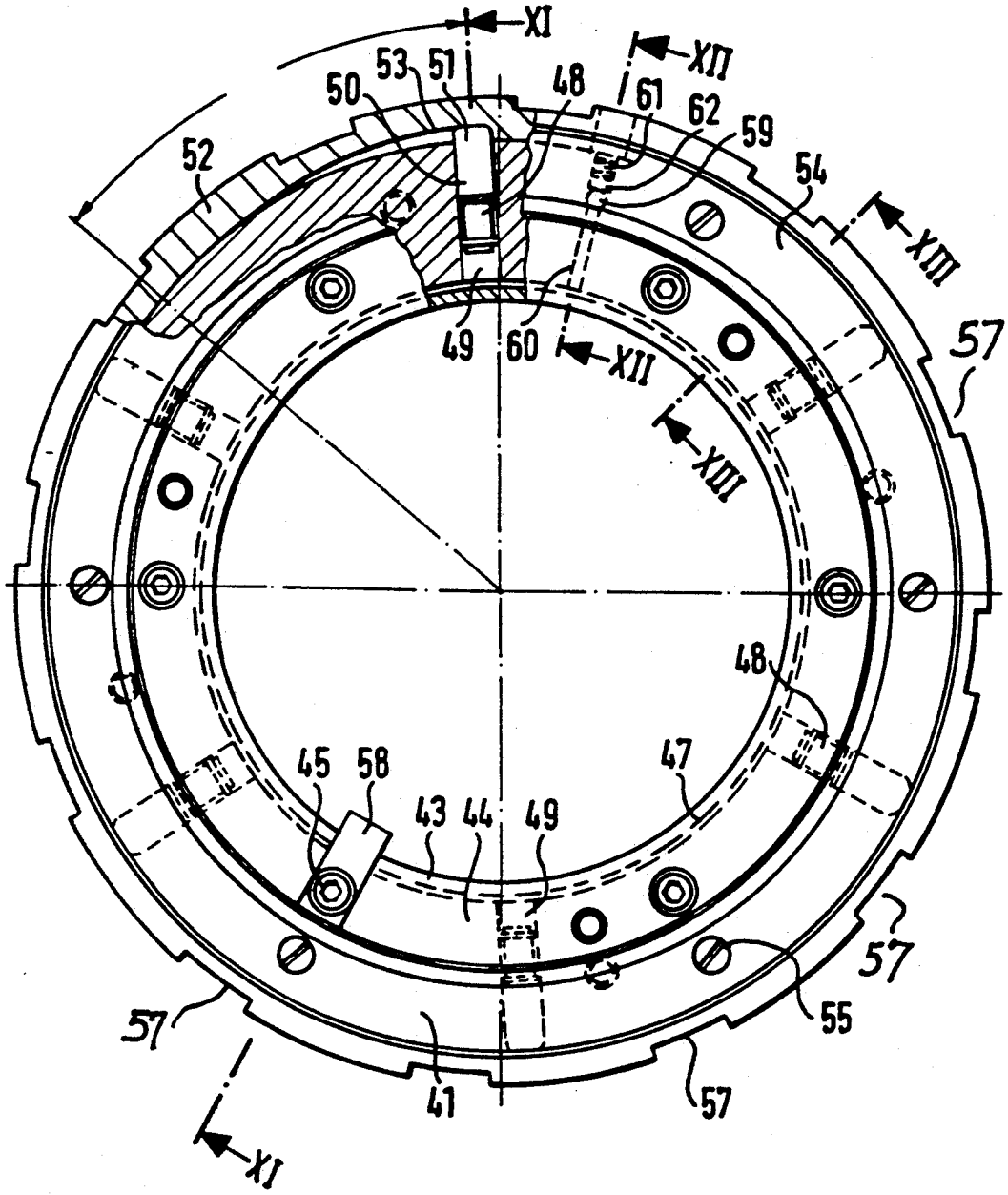
FIG. 10 is an axial end view, partly in section, of the clamping system of the invention in another embodiment.

Embodiment of FIG. 10, and with reference also to FIG. 11:

FIG. 11 is an axial cross-sectional view along the angled section line 11—11 of FIG. 10. The positioning or carrier sleeve 41 is coaxial with respect to the axis of the cutter wheel shafts 6, 7. The cutter wheel 42 is clamped to the positioning ring or roller 41, by being secured thereto, for example, by an axially extending bolt or the like, shown only schematically in FIG. 11, to permit replacement of the cutter wheel roller 42. A sleeve 43 which is of thin-wall construction is located within the positioning ring 41, for surrounding the shafts 6, 7 effectively without play. The sleeve 43 has a radial flange 44. Screws 45 connect the radial sleeve 44 to the positioning ring 41. A hollow cylindrical pressure space 47, which is closed off at both ends by circumferential seals 46, is formed between the sleeve 43 and the positioning ring 41. Upon application of a pressure fluid, sleeve 43, due to its thin-wall characteristics which give it sufficient elasticity, can clamp itself circumferentially uniformly about the shafts 6, 7. This locates the positioning sleeve concentrically to the shaft, and the cutter wheel 42 will be in precise radial alignment, and not be tipped or tilted with respect to the axis of the respective shaft 6, 7.

A plurality of pressure pistons 48 are located in the positioning sleeve 41, radially movable, to provide the requisite pressure of a pressure fluid within the space 47. Cylinders 49, formed in the positioning ring 41, are in direct pressure fluid communication with the pressure space 47. At the side of the pistons 48 remote from the pressure space, the pistons 48 are formed with a rounded, for example spherical or part-spherical surface 51 which radially projects beyond the positioning or carrier ring 41.

An operating ring 52 is rotatably located on the positioning or carrier ring 41. The operating ring 52 has radially varying cam tracks 53 at the inside thereof, against which the cam follower surfaces, for example part-spherical surfaces 51, engage. A cover ring 54, for example a C-ring, axially guides and locates the operating ring 52. If the cover ring 54 is formed as a washer or the like, screws 55 can be used to secure it to the positioning ring 41. A flange 56 is formed at the side remote from the open face on the positioning ring 41 which guides the axial position of the operating ring 52.

The operating ring 52 is formed along its circumference with a plurality of grooves or notches 57 which correspond to the notches 15 in the operating ring 22, FIGS. 3, 4, 5.

Operation:

Upon relative rotation of the shafts 6, 7, and hence of the positioning sleeve 41, and the operating ring 52, cam tracks 53 of the operating ring 52 will cause axial shifting of the pistons 48, either in the direction to fill or to empty the pressure space 47 and hence, respectively, clamping or release of clamped position of the positioning ring 41 with respect to the shaft.

The arrangement of FIGS. 10 and 11 clamps the positioning ring 41, and hence the cutter roller 42 on the shafts 6, 7 uniformly about the entire circumference of the shaft, so that the cutter roller 42 cannot tip or tilt with respect to the axis of rotation of the respective shaft 6, 7.

A lock 58 clamps the positioning sleeve 41 in a groove of the respective shaft 6, 7, so that the positioning sleeve 41 can be axially moved along the length of the groove, but will be carried along with rotation of the shafts 6, 7. A screw 45 also attaches the lock element 58 and the radial flange 44 of the thin-wall sleeve 43. The sleeve 43 is shown in FIG. 11 with exaggerated thickness for ease of illustration.

The basic structure of FIGS. 10 and 11 can be further modified or improved by providing a vent bore 60 (FIG. 12) which is in fluid communication with the pressure space 47 and which permits venting air from the space 47 when the space 47 is filled with a pressure liquid. The vent bore 60 is closed by a ball 59 and a closure plug 61.

The fixed connection between the deformable sleeve 43 and the positioning ring 41 is shown also in FIG. 13, in which, additional to the screws 45, locating pins 63 are illustrated. The locating pins accurately coaxially position the sleeve 43 within the positioning ring 41 and about the respective shafts 6, 7.

Figure 14:
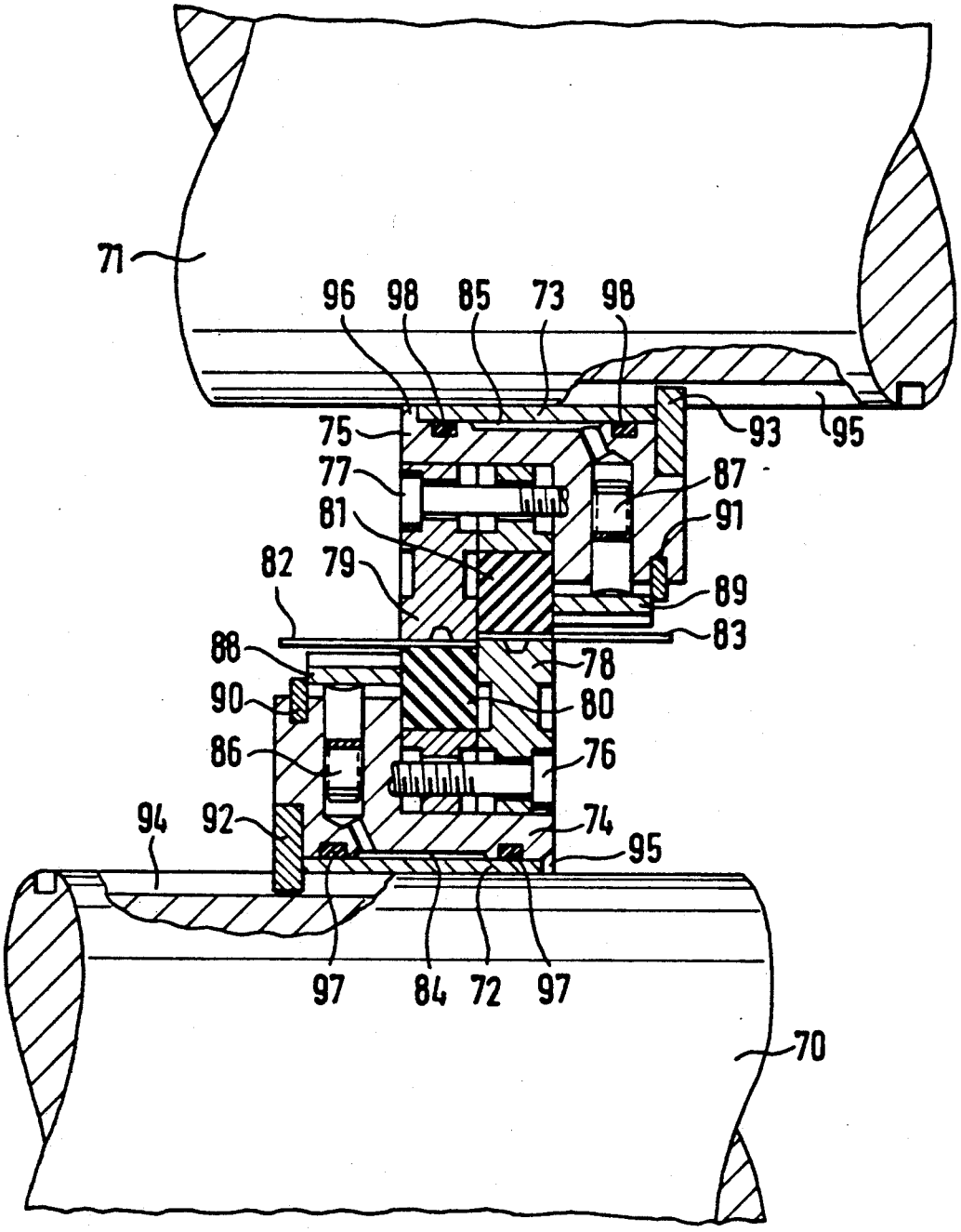
FIG. 14 is an axial part-sectional view of a complete cutting system, illustrating a modified embodiment, but generally similar to that of FIGS. 11-13.

Embodiment of FIG. 14:

FIG. 14 is an axial fragmentary cross-sectional view of the clamping system basically shown in FIG. 14, in which, further, the cooperation of two cutter rollers on two shafts is illustrated.

The shafts 6, 7, in FIG. 14, are illustrated as fragmentary shafts 70, 71. The thin-wall sleeves 72, 73 are applied about the shafts 70, 71, over which the positioning or carrier rings 74, 75 are fitted. Screws 76, 77 attach the cutter wheels, rollers or disks 78, 79 to the carrier rings 74, 75. Rubber rings or rubber rollers 80, 81 are located adjacent the cutter disks, for better guidance and gripping of the web which is being cut. The rubber rollers may be formed with circumferential reinforcement fibers or roving, as only schematically indicated in FIG. 14.

Cylindrical hollow pressure spaces 84, 85 are located between the respective positioning rings 74, 75 and the resiliently deformable sleeves 72, 73. Pressure fluid, for example a pressure liquid, can be applied under pressure by the pistons 86, bores formed in the positioning or carrier rings 74, 75, as described previously.

The operating rings 88, 89 are held in position between C-rings 90, 91 and the outer face of the rubber rings 80, 81 for axially locating the respective operating rings. This simplifies the overall construction and manufacture of the positioning or carrier rings 74, 75.

The rotation transfer lock 92, 93 between the carrier or positioning rings 74, 75 engage in longitudinal grooves 94, 95 of the respective shafts 70, 71 to provide for an axially movable, but rotation-transmitting connection.

The cutter or knife disks or rollers 78, 79 overlap in their outer contour, resulting in a shearing or scissor effect which can sever a web into respective ribbons or cut or sub-webs 82, 83.

The cutter knives or rollers 78, 79 have circumferential grooves formed therein, for ease of handling and removal of fluff and the like. The operating rings 88, 89 are formed with operator-accessible axial grooves, to permit relative rotation of the respective operating ring with respect to the associated shaft, and hence ready axial positioning or re-positioning of the entire assembly and renewed clamping of the respective positioning element by pressurizing the pressure spaces 84, 85.

The deformable sleeve 72, 73 is located in position—as appears in FIG. 14—between a flange 95, 96 of the positioning or carrier rings 74, 75, respectively, and the locking bar or rod 92, 93 which ensures conjoint rotation of the respective shaft and the positioning ring. This results in a particularly simple construction; the circumferential seals 97, 98, at both sides of the pressure spaces 84, 85, is completely enclosed by oppositely acting elements, namely the sleeve 72, 73 and the positioning rings 74, 75, respectively, so that a tight seal, meeting all requirements, will be obtained.

Figure 15:
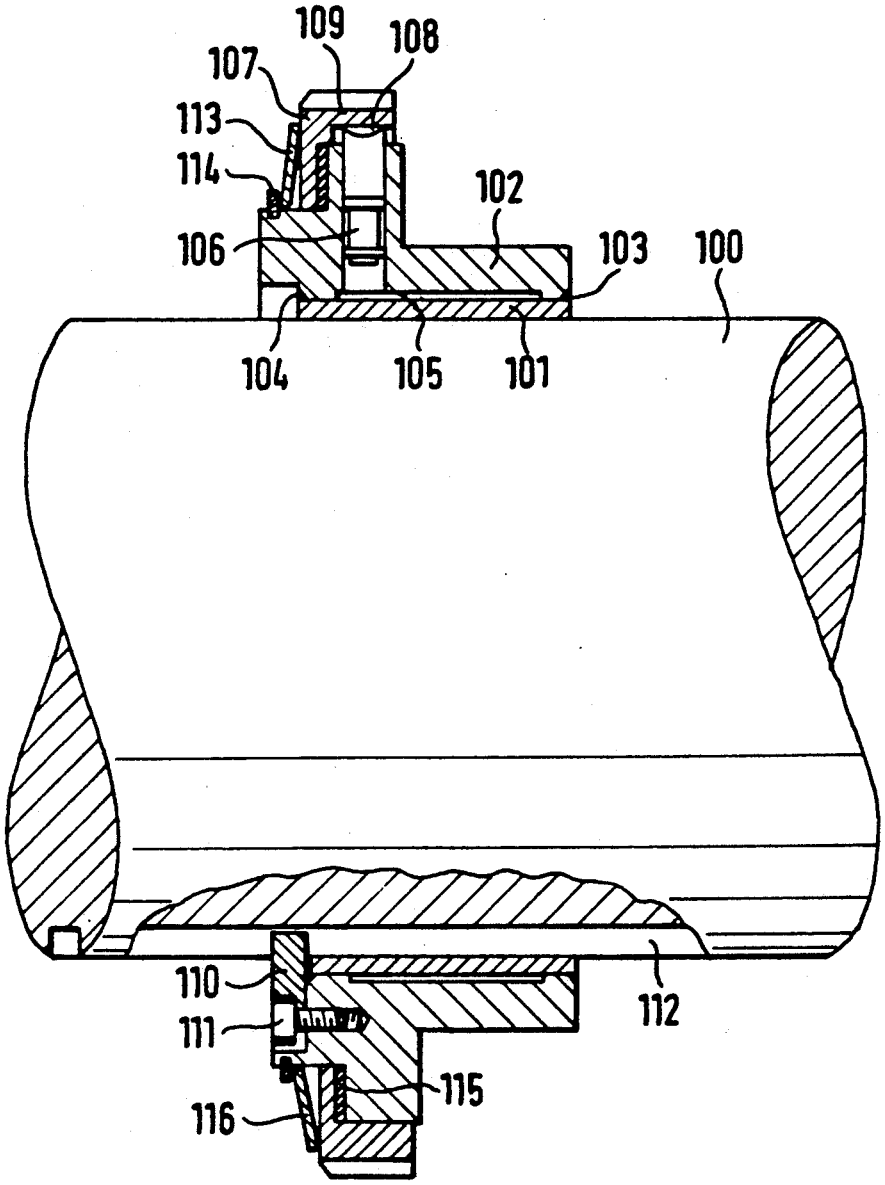
FIG. 15 is an axial cross-sectional view through another embodiment based on the general structure of FIGS. 11-13.

Embodiment of FIG. 15;

The deformable sleeve is here formed by an essentially cylindrical element 101, fitted about the shaft 100, and within a positioning ring 102, which, together with the sleeve 101, is normally axially shiftable about the shaft 100. The sleeve 101 and the positioning ring 102 are connected by welds 103, 104, for secure attachment therebetween, so that the cylindrical pressure space 105 is tightly closed at both ends.

The positioning or carrier ring 104 retains a radially adjustable pressure piston 106, the pressure side of which is in fluid communication with the pressure space 105. The end surface of the piston 106 is formed as a round, for example part-spherical cam follower surface 108, which is in operative association with a cam track 109 of the operating ring 107. The arrangement can be similar to that heretofore described, for example in connection with FIGS. 3, 4, 10 and 11. FIG. 15 also shows the rotation coupling 110 of the positioning ring for rotation with the shaft 100, which, again is an internally projecting pin element, coupled by screws 111 to the positioning sleeve 102, and engaged in a groove 112 of the shaft 100, and extending axially therealong.

An important difference with respect to the prior embodiments is the retention of the operating ring 107 by a cup or washer or dish spring 113, which is axially retained on the positioning ring 102 by a snap C-ring 114, and engaged against a friction layer 115, located between a radially inner directed flange 116 of the ring 109 and a projecting portion of the positioning ring 102. The combination of the spring 113 and the friction layer or friction coating 115 forms a brake, which prevents possible shift of the operating ring 107 with respect to the positioning or carrier ring 102. Such shifts might occur, for example, by oscillations and the like and might lead to possible loosening of the tightly clamped engagement of the positioning ring 102 on the shaft 100.

A friction brake of this or other similar types can, of course, be used with any one of the various conditions in which loosening of the operating ring might be a problem.

Figure 16:
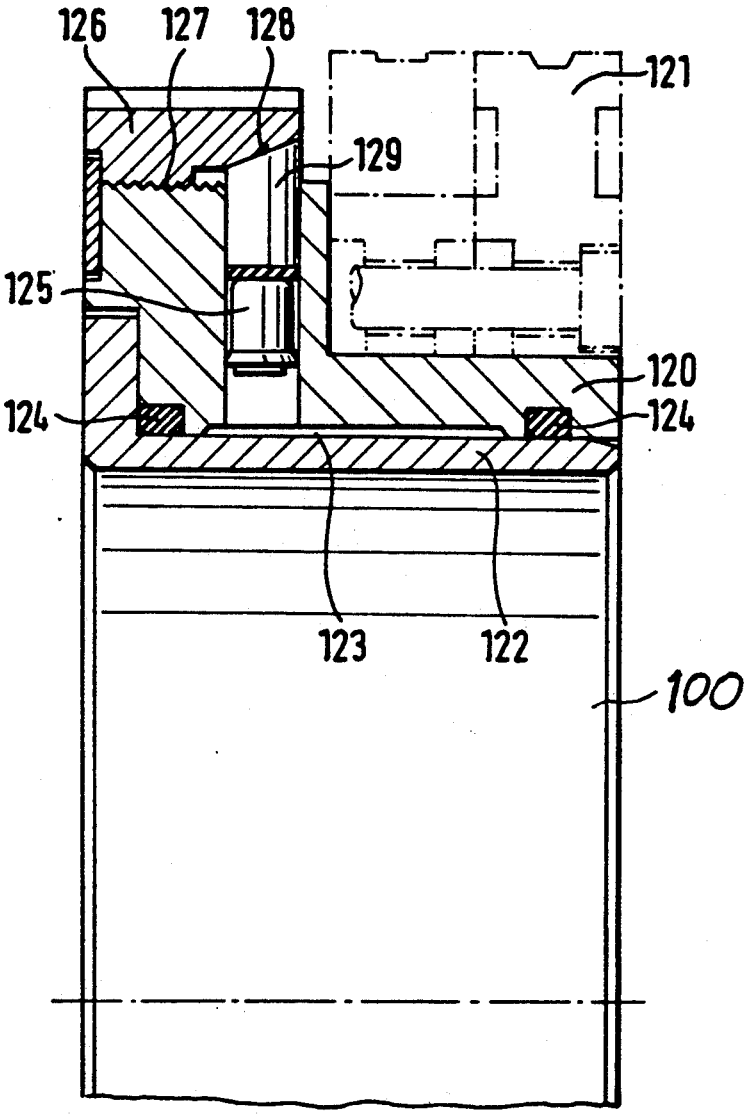
FIG. 16 is a fragmentary axial view of another embodiment having a radially positionable pressure piston.

Embodiment of FIG. 16:

This construction is similar to that previously described, and had a positioning ring 120 on which a cutter wheel 121 is clamped. A deformable sleeve 122 is located between the positioning ring 120 and the respective shaft to define a pressure space 123, sealed against the outside by seals 124. The seal, just as the seals 46 (FIGS. 11-13) and seals 97, 98 (FIG. 14), may be made of reinforced elastomer, with reinforcing fibers or strands embedded therein.

A radially movable pressure piston 125 is located within the positioning ring 120, in fluid communication with the pressure space 123.

The operating ring 126 as well as the outside of the positioning ring 120 include interengaging threads 127, so that, upon relative rotation of the operating ring 126 with respect to the positioning ring 120, a coaxial camming surface, for example a conical surface 128, will radially shift a shaft 129 extending from the piston 125, and, in dependence on rotation of ring 126, effect clamping or unclamped position of the positioning ring 120 with respect to the sleeve 122 and hence the shaft on which it is located.

Figure 17:
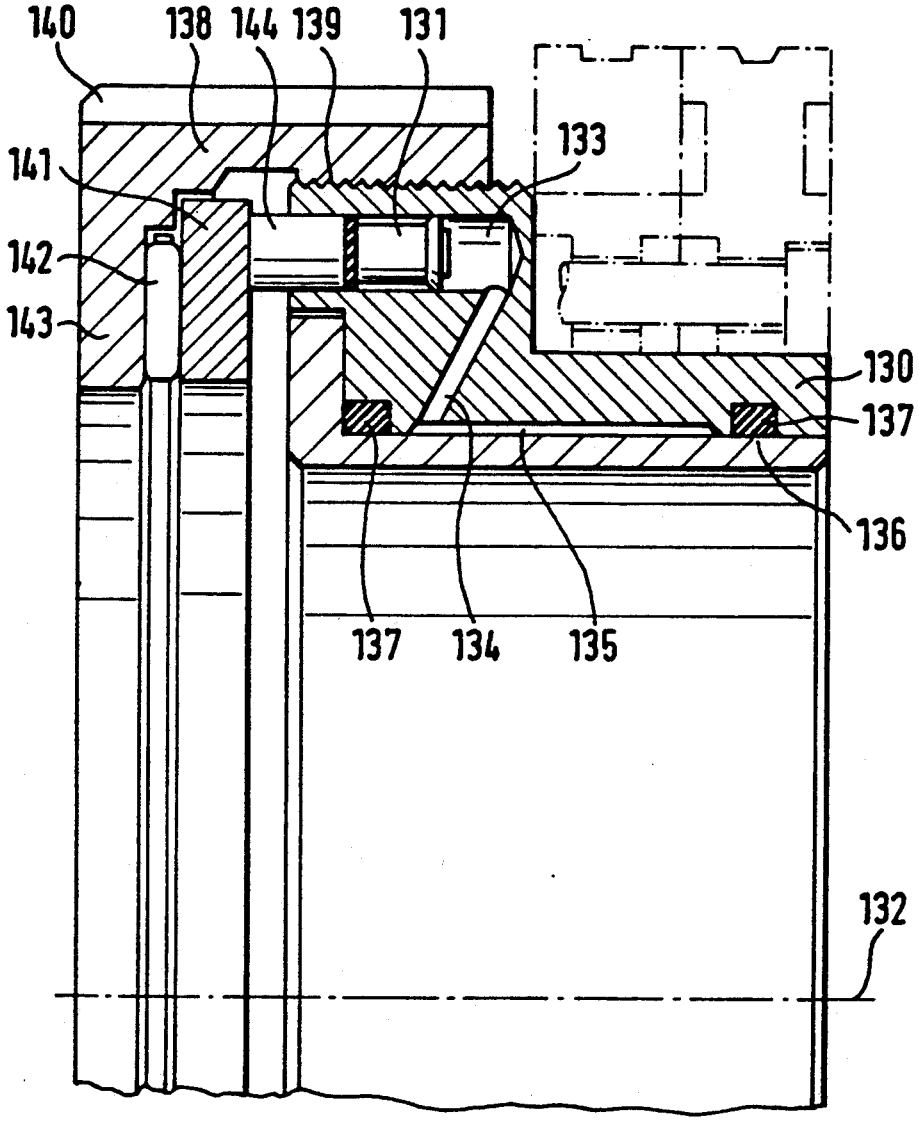
FIG. 17 is a fragmentary axial section having an axially shifting pressure piston.

Embodiment of FIG. 17:

A pressure piston 131 is located within the positioning ring 120, but shiftable axially, that is, in parallel to the axis of rotation 132 of the shaft. It is located in a bore 133, forming a cylinder, which is connected via a fluid communication duct 134 with the pressure space 135, formed between the positioning ring 130 and a deformable sleeve 136. The pressure space 135 is sealed by reinforced sealing rings 137.

The operating ring 138 is located on a thread 139 of the positioning ring 130, and shiftable in axial direction upon engagement of the operating ring 138 with a suitable tool fitted in grooves 140 thereof. Upon such change of the axial position of the operating ring, the pressure piston 131 is shifted parallel to the axis of rotation 132. Transfer of the shifting movement is effected by a ring 141, which is supported by a needle bearing 142 against a radially inwardly directed flange 143 of the operating ring 138. This arrangement is particularly suitable to reduce friction resulting from relative movement between the positioning ring 130 and the operating ring 138, and the shaft 144 of the pressure piston 131.

This construction may also be used in the embodiment in accordance with FIGS. 5 and 16, by separating the positioning ring into two parts, one including the forward part having the conical or camming surface, and then interposing an axial bearing with respect to the rest of the positioning ring.

The arrangements of FIGS. 10, 11, 15 and 17 do not require that the pressure space extend entirely about the circumference of the shaft; it may extend only over a portion of the circumference thereof. Still, clamping force is applied over a predetermined region which still results in secure and definite engagement of the cutter roller on the shaft, so that wobble of the cutter roller, and/or the positioning or carrier ring will not occur.

Figure 18:
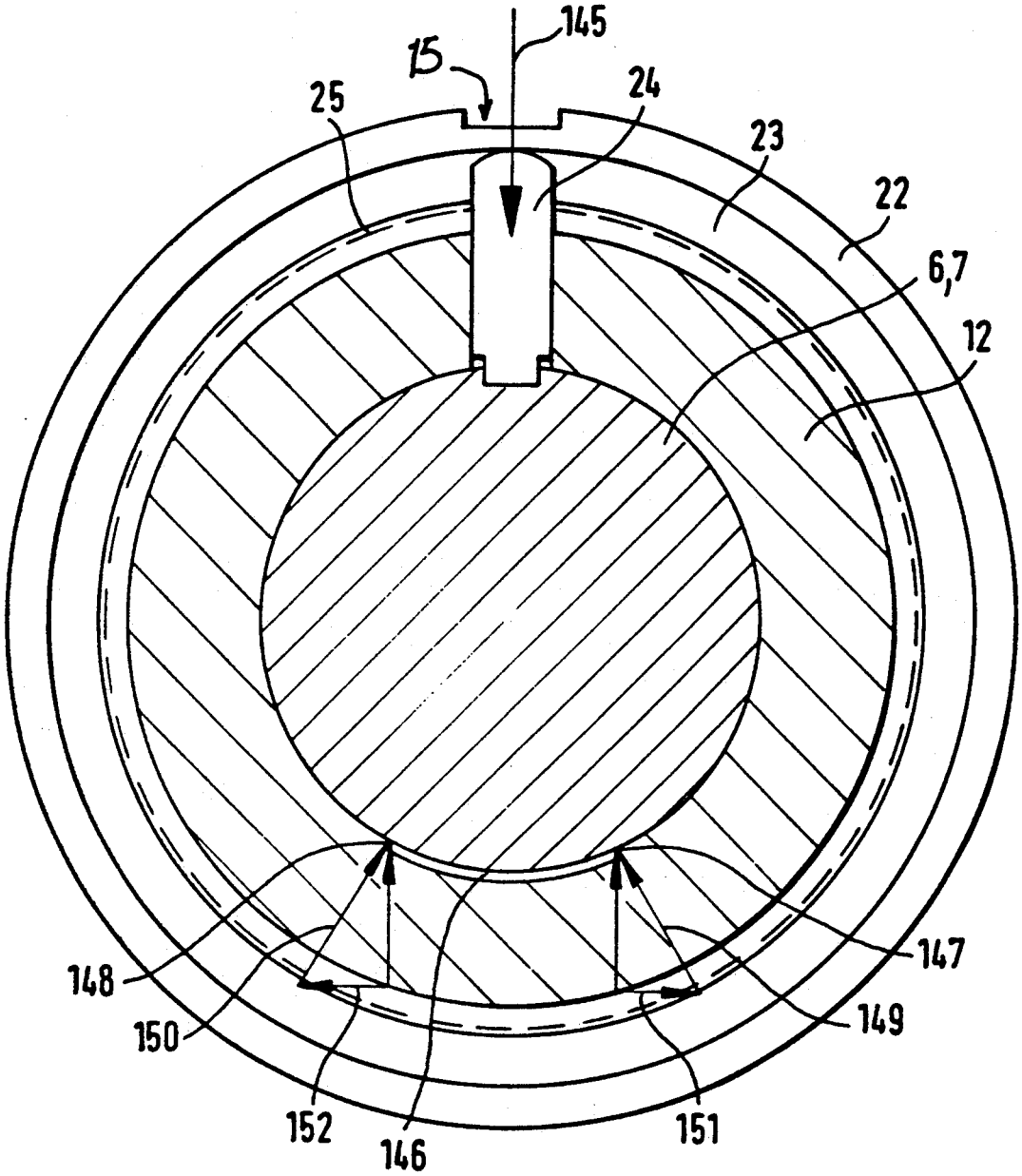
FIG. 18 is a section along line XVIII—XVIII of FIG. 5 and illustrating an axial recess in the inner contour of the positioning ring, and force relationships which will then pertain.

FIG. 18 illustrates another arrangement to provide for secure engagement of the respective carrier or positioning ring on the shaft, while preventing tipping or wobble of the carrier ring and/or the cutter wheel upon rotation of the shaft. FIG. 18, for purposes of illustration, is a sectional view of FIG. 5, although the arrangement described in connection therewith can be used with any of the other embodiments.

As illustrated in FIG. 18, shifting the operating ring 22 will apply a force schematically shown by arrow 145 by transfer of clamping force over the camming surface 23 of the radially shiftable element 24.

In accordance with a feature of the invention, the positioning or carrier ring 12 is formed with a recessed portion 146 at the inner contour thereof. The recess 146 extends axially and is parallel to the axis of the respective shaft 6, 7. The clamping force with respect to the shafts 6, 7 then is applied, effectively, against a recess or hollow portion, and the edges 147, 148 of the recess will be engaged against the shaft. The edges 147, 148 of the recess 146 will thereby form two linear engagement contacts, against which reaction forces illustrated by arrows 149, 150 will act, that is, together counteracting the clamping force 145. The reaction forces shown by arrows 149, 150, with respect to the clamping force 145, have horizontal components 151, 152. These cross components of force, as shown by arrows 151, 152, provide for particularly good attachment and holding of the positioning or carrier sleeve 12 on the respective shafts 6 and 7, transversely to the effective direction of the clamping force, shown by arrow 145. This arrangement, thus, retains the positioning or carrier ring in secure alignment on the respective shaft and effectively counteracts any wobble of the positioning or carrier ring and hence of the cutter wheel coupled thereto.

The operating ring can be retained on the positioning ring in various ways, and adjusted rotationally with respect thereto. In one way, a thread is formed on the positioning or carrier ring and engages a matching thread on the operating ring, to provide for axial shifting of the operating ring which, then, is formed with a camming track, for example a conical surface concentric to the axis of rotation of the shaft. Relative movement between the operating ring and the carrier ring, thus, can be used to operate the clamping arrangement as such. Due to the presence of the thread, rotation between the operating ring and the carrier ring results in axial shift of the operating ring with respect to the carrier ring which, by virtue of the conical surface at the inside of the operating ring, or of an element coupled thereto, operates the respective clamping arrangement, and hence clamps the operating ring and the cutter wheel coupled thereto to the respective shaft.

The axial portions of the operating ring, which contain the conical or camming surface, can be separated from the remaining portion or part, and an axial bearing interposed. This substantially reduces frictional forces upon relative rotation between the conical surface and the clamping elements. The spiral relative movement of the operating ring with respect to the clamping elements is previously already decoupled. A slide bearing, a needle bearing, roller or ball bearing may be used.

The operating ring can also be coupled to the clamping elements by an essentially radially directed camming surface, and the clamping element, then, including an axially shiftable portion or part. Thus, the camming or clamping surface may be a circular ring located on the operating ring and/or on the carrier ring, and axially movable, in which the circular ring is supported with respect to the operating ring again by an axial bearing, which may be a slide bearing, or a roller, sleeve or needle bearing. It is, thus, possible to move the clamping elements within the carrier or positioning ring either in radial or in axial direction.

A brake to limit or inhibit random rotation of the operating ring with respect to the carrier or positioning ring may be suitable under some conditions, particularly if oscillations or vibrations are to be expected. Under usual conditions, shift of the position of the operating ring with respect to the carrier or positioning ring cannot be expected during operation of the cutter system. For increased safety and reliability, and if possible oscillations may occur, a brake, as illustrated for example in connection with FIG. 15, may be used.

A brake may be particularly suitable if the web material which is to be cut is frequently changed, so that acceleration and deceleration forces will frequently be transferred from the cutter rollers or wheels on the positioning or carrier ring. Such a brake is readily capable of absorbing such acceleration and deceleration forces. The brake is easily made and applied, for example by pressing, by a spring or the like, the operating ring and the positioning ring against each other, preferably with an interposed brake or friction material.

If the operating ring has a radially directed surface and the clamping element includes an axially shiftable element, it is desirable to transfer the radial to axial forces by utilizing a pressure pin or the like, which engages a conical surface. This is a mechanical force alignment system. It is equally possible, however, to re-position the direction of applied force by a hydraulic system, and to form the axially shiftable part as a hydraulic piston which is in hydraulic pressure connection with a slidable element acting radially, and positioned in or on the operating or carrier ring. The second hydraulic element, operated hydraulically by the piston, may be again a radially shiftable hydraulic system or a clamping sleeve directly. A hydraulic force transfer has the advantage that the plane in which the operating ring acts against a first shiftable element and the plane in which a further movable part affects clamping between the positioning or carrier ring and the shaft can have any desired axial space with respect to each other, or any desired geometric configuration. Thus, an arrangement in which the force element acts also beneath the portion of the positioning or carrier ring on which the cutter rollers or cutter disks are located may be desirable and of advantage.

If mechanical parts are used, radially shiftable elements which clamp the positioning or carrier ring to the shaft can be frictionally coupled bolts, or frictionally coupled clamping balls, which are switched between clamped and released position, directly or indirectly by the operating ring. These elements may have a dual use, in that they position the axial alignment of the carrier or positioning ring on the shaft and, additionally and simultaneously, ensure rotary coupling of the carrier or positioning ring to the shaft, by engagement in a suitable axially extending groove of the shaft, and in which they are continuously engaged and located.

The positioning ring and the shaft can also be clamped together by forming a converging gap between the shaft and the positioning ring and introducing a clamping element therein, which essentially fills the converging gap. The clamping element then is sickle-shaped and pressed against the shaft, for example by applying pressure thereagainst in the region of its thickest part. The sickle-shaped element may be split, by engaging conical or wedge surfaces between the split parts, upon radial shifting of a clamping pin formed with conical spreading surfaces. Such bodies can provide for particularly high clamping forces. To ensure ready release, upon withdrawal of the radially shiftable elements, the clamping surfaces of the radially shiftable part, and the corresponding flanks of the clamping elements, that is, the sickle-shaped elements, are preferably coupled by an interlock coupling, such as a dovetail connection or the like.

A hydraulic solution corresponding to the aforementioned mechanical clamping solution provides for a hydraulic piston which, upon shifting thereof, changes the pressure of a pressure fluid, for example a suitable hydraulic oil, within a pressure space located between a sleeve or sleeve portion surrounding, at least in part, the shaft and located inwardly of the positioning or carrier ring. The hydraulic piston can be radially as well as axially moving, and can be controlled by a radially or axially located camming or operating surface coupled to the operating ring. The sleeve surrounding the shaft, preferably, surrounds it with as little play as possible.

The pressure space can be closed off by welding, brazing or soldering the sleeve to the positioning or carrier ring; alternatively, the pressure space can be formed by making the sleeve separately of the carrier ring and inserting sealing elements therebetween which, preferably, are reinforced. The sleeve can entirely surround the shaft or only a portion thereof.

In another and mechanical form, the positioning ring and the shaft are clamped upon operation of an operating ring by engaging the operating ring via an inner groove extending axially therein with a radially outwardly projecting pin or bolt of a clamping ring located between the shaft and the positioning or carrier ring, and essentially without play. The clamping ring is formed to have an eccentric cross section throughout its circumference. Upon relative movement between the operating ring and the positioning or carrier ring, a clamping force will be obtained which is transferred from the positioning ring against the shaft. The operating ring can be axially movable or axially shiftable on the positioning ring, with suitable camming surface engaging the clamping element.

Various changes and modifications may be made, and any features described herein with respect to any one of the embodiments may be used with any of the others, within the scope of the inventive concept.

We claim:

1. Clamping system for clamping a cutter roller or cutter wheel (2, 3; 4, 5; 11; 42; 78, 79; 121) on a shaft (6, 7; 70, 71; 100) comprising a positioning or carrier ring (12, 41, 74, 75, 102, 120, 130) to which said cutter roller is secured, said positioning or carrier ring being located on said shaft and coupled to said shaft for rotation therewith, while being selectively axially positionable along said shaft;

clamping means (20, 21; 24; 32, 36, 37, 43, 72, 73, 101, 122, 136) for selectively clamping said positioning ring or carrier ring at a selected axial position on said shaft; and a rotatable operating ring (13, 22, 28, 40, 52, 88, 89, 107, 126, 138) located on said positioning or carrier ring (12, 41, 74, 75; 102, 120, 130) essentially concentrically to said shaft (6, 7; 70, 71; 100), rotatable about said positioning or carrier ring, and operatively coupled to said clamping means for selectively effecting clamping engagement of said clamping means with said shaft when a desired axial position of the cutter roller (2, 3; 4, 5; 11; 42; 78, 79; 121) has been determined and release of said cutter roller from said desired axial position for re-positioning of said cutter roller, said rotatable operating ring being operable independently of a predetermined circumferential position of said shaft.

2. The system of claim 1, wherein said operating ring (13, 22, 28, 40, 52, 88, 89, 107, 126, 138) includes means (15, 57, 140) for engagement therewith for controlling relative rotation of the operating ring with respect to said positioning or carrier ring (12, 41, 74, 75; 102, 120, 130).

3. The system of claim 1, wherein said operating ring (13, 52, 88, 89, 107) is formed with a cam track (16, 53) which changes its radial distance with respect to the circumferential extent of said positioning or carrier ring (12, 41, 74, 75, 102), said cam track being operatively coupled to said clamping means (20, 21, 43, 72, 73 101);

and wherein said clamping means include radially shiftable elements (17, 50).

4. The system of claim 3, wherein (FIGS. 3, 4; 10-15) said radially shiftable elements (17, 50) are located within the positioning or carrier ring (12, 42, 74, 75; 102).

5. The system of claim 3, wherein (FIGS. 3, 4; 10-15) the operating ring (13, 52, 88, 89; 107) is rotatable supported on said positioning or carrier ring (12, 41, 74, 75; 102).

6. The system of claim 1, wherein (FIGS. 5, 16) the operating ring (22, 126) and the positioning or carrier ring (12, 120) are formed with engaging threads (25, 127) extending in a direction parallel to the axis of rotation of said shaft (6, 7, 100);

a camming surface (23, 128) is formed on said operating ring (22, 126); and said clamping means include a radially shiftable element (24, 129) operatively coupled to said camming surface.

7. The system of claim 6, wherein said camming track is a conical track with a cone axis concentric with the axis of rotation of said shaft.

8. The system of claim 6, wherein said operating ring (22, 126) is a two-part element including a ring part and a cam track part;

and an axial bearing (33, 142) is interposed between said parts.

9. The system of claim 1, wherein (FIGS. 6, 7, 17) the operating ring (28, 138) and the positioning or carrier ring (12, 130) are formed with interengaging thread means (25, 139) extending in a direction parallel to the axis of rotation of said shaft;

and wherein said operating ring is formed with an essentially radially directed engagement surface (29), and the clamping means include axially shiftable clamping elements (30, 34, 144) in operative engagement with said engagement surface (29).

10. The system of claim 9, wherein at least one of;

said operating ring (28, 138) and said positioning or carrier ring (12, 130)

is a two-part element defining to parts;

an axially movable force transfer ring (41) is provided, positioned between said parts;

and an axial bearing (33, 142) is interposed between at least one of said parts and said transfer ring.

11. The system of claim 9, wherein (FIG. 6) said axially shiftable element (30) comprises at least one pressure pin (30) formed with a wedging surface (31) at an end thereof;

and said clamping means includes an essentially radially shiftable element (32) engageable by said wedging surface (31).

12. The system of claim 1, including (FIG. 15) a brake (115) acting on the operating ring.

13. The system of claim 12, including resilient means (113) resiliently engaging said operating ring (107) and said positioning or carrier ring (102) against each other, with said brake interposed, for resiliently engaging said brake between said rings.

14. The system of claim 1, wherein (FIG. 7) said clamping means comprises at least one hydraulic piston (34);

and a clamping force transfer element (36) hydraulically coupled to said hydraulic piston (34) for clamping said positioning ring at said axially selected position.

15. The system of claim 14, wherein said clamping force transfer element (36) is located within said positioning or carrier ring (12) and is movable in an essentially radial direction.

16. The system of claim 1, wherein (FIGS. 5, 7) said clamping means includes a bolt (24, 36) radially shiftably located within said carrier or positioning ring (12) and engageable with said shaft (6, 7) by frictional coupling therewith.

17. The system of claim 1, wherein (FIG. 6) said clamping means includes a clamping ball (32) radially shiftably located within said carrier or positioning ring and engageable with said shaft (6, 7) by frictional coupling therewith.

18. The system of claim 1, wherein (FIGS. 5, 6) said shaft (6, 7) is formed with an axially extending groove or notch (27);

and wherein said clamping means (24, 32) comprises a radially shiftable element (24, 32) in continuous engagement with said groove or notch to provide for rotary force transfer between said shaft and said positioning or carrier ring while, simultaneously, axially positioning the positioning or carrier ring in a predetermined axial location on said shaft.

19. The system of claim 1, wherein (FIGS. 3, 4) said positioning or carrier ring (12) is formed to provide, with respect to said shaft (6, 7), a circumferentially converging gap;

wherein said clamping means comprises a two-part, in cross section essentially sickle-shaped clamping element, separated into said parts (20, 21) of said element in the region of the radially largest thickness of said clamping means;

and wherein said clamping means further comprises a radially shiftable element (17) formed with wedging surfaces (18, 19), engaged between said parts of the sickle-shaped clamping element, said sickle-shaped clamping element essentially filling said gap between said two parts.

20. The system of claim 19, wherein (FIGS. 3, 4) said clamping parts define end surfaces; and the wedging surfaces (18, 19) of the clamping means (17) and the end surfaces of the clamping parts (20, 21) are formed with interlocking means.

21. The system of claim 1, wherein (FIGS. 10-17) said clamping means comprises means (46; 97, 98; 103, 104; 124; 130, 137) for forming a pressure space or pressure chamber (47, 84, 85, 105, 123, 135), said pressure space or pressure chamber being positioned between said circumference of said shaft (70, 71; 100) and surrounding said shaft, at least in part, essentially without play or leakage;

and wherein said clamping means further includes a hydraulic pressure piston (48, 86, 87; 106, 125, 131)

in fluid communication with said pressure space or pressure chamber.

22. The system of claim 21, further including a sleeve element (43; 72, 73; 101; 122, 136) surrounding said shaft (70, 71; 100) at least in part, and forming said pressure space or pressure chamber forming means, said sleeve element being sealed to said positioning or carrier ring and defining therewith a gap forming said pressure space or pressure chamber.

23. The system of claim 22, wherein said sleeve element comprises deformable metal and is welded to said positioning or carrier ring.

24. The system of claim 22, wherein said sleeve element comprises a replaceable element;

and sealing means (46; 97, 98; 124, 137) are provided sealing said pressure space or pressure chamber formed between the sleeve element and said positioning or carrier ring.

25. The system of claim 1, wherein (FIGS. 8, 9) said operating ring (40) is formed with an inner groove (39) extending parallel to the axis of rotation of said shaft (6, 7); and said clamping means (37) comprises a ring element having eccentric cross section throughout its circumference, positioned between said positioning or carrier ring (12) and said shaft (67), said clamping means including a radially extending projection (38) engaged in said inner groove (39) of the operating ring.

26. The system of claim 25, wherein the operating ring is rotatable, yet axially fixed on said positioning or carrier ring.

27. The system of claim 1, wherein (FIG. 18) said positioning or carrier ring (12, 41, 74, 75; 102, 120, 130) is formed with an axially extending groove, parallel to the axis of rotation of said shaft, and defining, at the junction of said groove (146) and the remainder of the inner surface of said positioning or carrier ring, locating abutments (147, 148) for positioning the respective shaft (6, 7; 70, 71, 100) within said positioning or carrier ring.

28. The system of claim 27, wherein said clamping means engage the shaft (6, 7; 70, 71; 100) at a predetermined diametrical position of said shaft; and wherein said locating abutments (147, 148) are located angularly offset and diametrically opposite said clamping means for three-point engagement of said shaft with said abutment and clamping means, respectively.

* * * * *